US006153987A

United States Patent [19]

Toda et al.

[11] Patent Number: 6,153,987

[45] **Date of Patent: *Nov. 28, 2000**

[54] LIGHTING CIRCUIT FOR DISCHARGE LAMP

[75] Inventors: Atsushi Toda; Masayasu Yamashita, both of Shimizu, Japan

[73] Assignee: Koito Manufacturing Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/864,898

[22] Filed: May 29, 1997

[30] Foreign Application Priority Data

Jun. 7, 1996 [JP] Japan ..... 8-166657

[51] Int. Cl.[7] ..... H05B 37/00; H05B 41/00; H05B 41/231

[52] U.S. Cl. ..... 315/308; 315/225; 315/360; 315/291

[58] Field of Search ..... 315/307, 308, 315/291, 225, DIG. 5, DIG. 7, 289, 290, 82, 224, 360

[56] References Cited

U.S. PATENT DOCUMENTS 5,068,570 11/1991 Oda et al. ..... 315/128
5,140,229 8/1992 Yagi et al. ..... 315/307
5,142,203 8/1992 Oda et al. ..... 315/308
5,151,631 9/1992 Oda et al. ..... 315/127
5,212,428 5/1993 Sasaki et al. ..... 315/224
5,278,452 1/1994 Matsumoto et al. ..... 307/10.8
5,295,036 3/1994 Yagi et al. ..... 361/79
5,422,548 6/1995 Yamashita et al. ..... 315/308
5,449,973 9/1995 Yamashita et al. ..... 315/82
5,485,059 1/1996 Yamashita et al. ..... 315/307
5,486,740 1/1996 Yamashita et al. ..... 315/308
5,514,935 5/1996 Oda et al. ..... 315/82
5,565,743 10/1996 Yamashita et al. ..... 315/310
5,572,094 11/1996 Yamashita et al. ..... 315/308
5,652,481 7/1997 Johnson et al. ..... 315/308

*Primary Examiner*—Arnold Kinkead
*Attorney, Agent, or Firm*—Fitzpatrick, Cella, Harper & Scinto

[57] ABSTRACT

A discharge lamp lighting circuit comprising power control means for executing lighting acceleration control to supply power greater than rated power to a discharge lamp to thereby expedite lighting of the discharge lamp, and constant power control on the discharge lamp with the rated power; and timer means for regulating a time for the lighting acceleration control by the power control means in such a way that the lighting acceleration control does not continue for a predetermined time or longer, at the beginning of the lighting of the discharge lamp or when the status of the discharge lamp after being lit changes.

9 Claims, 5 Drawing Sheets

LIGHTING CIRCUIT FOR DISCHARGE LAMP

BACKGROUND OF THE INVENTION

1. Field of the Invention

The present invention relates to a novel discharge lamp lighting circuit equipped with a control function to supply power exceeding the rated power to a discharge lamp to thereby propagate light.

2. Description of the Related Art

There is a known lighting circuit for a discharge lamp like a metal halide lamp, which supplies more power than the rated one to a discharge lamp in a transient state from the beginning of the lighting of the discharge lamp to the transition of constant power control in order to shorten the ignition time, thereby expediting lighting.

In the case where, with the service life of a discharge lamp at its last stage, the lamp voltage does not fall within, or comes off, the proper voltage range under constant power control, the conventional lighting circuit supplies power exceeding the rated power to the discharge lamp. If this state continues for a long period of time, heat generation from the circuit or some other overpower induced shortcoming occurs, and the circuit may be damaged at the worst.

One solution to the problem is to check if the lamp voltage or the lamp current of a discharge lamp deviates from a predetermined range and stop power supply to the discharge lamp when such matter happens.

This scheme disables one who has intended to light the discharge lamp from knowing the reason for turning off the lamp, or requires some means to inform the person of that reason.

SUMMARY OF THE INVENTION

Accordingly, it is a primary objective of the present invention to protect a lighting circuit, when a discharge lamp is not on under constant power control, by preventing supply of power greater than the rated one from being supplied to the discharge lamp for longer than a predetermined time.

To achieve the foregoing and other objects and in accordance with the purpose of the present invention, there is provided a discharge lamp lighting circuit comprising power control means for executing lighting acceleration control to supply power greater than rated power to a discharge lamp to thereby expedite lighting of the discharge lamp, and constant power control on the discharge lamp with the rated power; and timer means for regulating a time for the lighting acceleration control by the power control means in such a way that the lighting acceleration control does not continue for a predetermined time or longer.

This structure provided according to the invention can allow lighting acceleration control to be terminated before the predetermined time elapses, so that the lighting acceleration control for a discharge lamp does not continue more than needed.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENT

A preferred embodiment of the present invention will now be described with reference to the accompanying drawings.

Figure 1:
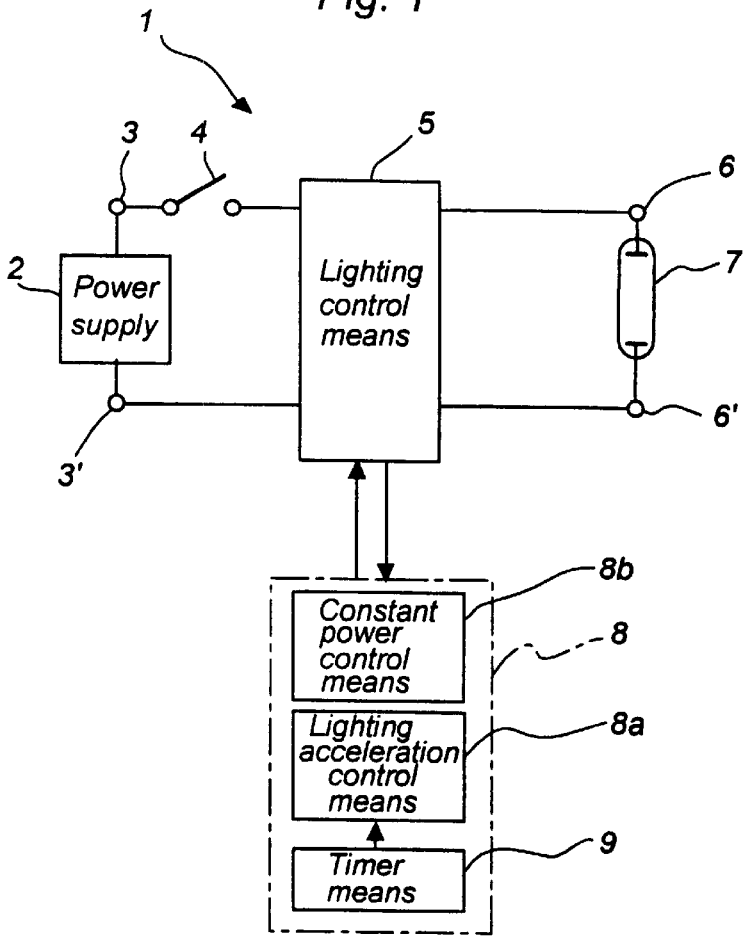
FIG. 1 is a block diagram for explaining the basic structure of the present invention.

FIG. 1 illustrates the basic structure of a lighting circuit 1 according to this invention. The lighting circuit 1 is designed in such a manner that a supply voltage from a power supply 2 is supplied via input terminals 3 and 3' and a lighting switch 4 to lighting control means 5 whose output is supplied to a discharge lamp 7 from output terminals 6 and 6'. The power supply 2 may generate a DC voltage or an AC voltage. The lighting switch 4 may be activated manually or automatically.

The lighting control means 5 serves to activate the discharge lamp 7 and supply power to the discharge lamp 7, and is controlled by an output signal from power control means 8.

The power control means 8 executes power supply control during transition from the time of activation of the discharge lamp 7 to a steady state, or constant power control with the rated power of the lamp 7, based on the lamp voltage or the lamp current of the discharge lamp 7, which is detected in the lighting control means 5, or a signal equivalent to the detected lamp voltage or lamp current. For this purpose, the power control means 8 has lighting acceleration control means 8*a* and constant power control means 8*b*.

The constant power control means 8*b* carries out constant power control on the discharge lamp 7 with the rated power to ensure stable lighting of the lamp 7. The lighting acceleration control means 8*a* supplies power greater than the rated power to the discharge lamp 7 to expedite or accelerate the lighting of the lamp 7 during a transient period from the beginning of the activation of the lamp 7, in which the lamp 7 comes under constant power control, or when the lamp 7 becomes off the domination of the constant power control means 8*b*. To prevent any problem which will originate from the continuation of such lighting acceleration control over a long period of time (e.g., heat generation from the circuit that is caused when a discharge lamp in the last stage of life comes free of constant power control), the lighting acceleration control means 8*a* is provided with timer means 9 to prevent the lighting acceleration control from continuing for a predetermined time or longer.

Figure 2:
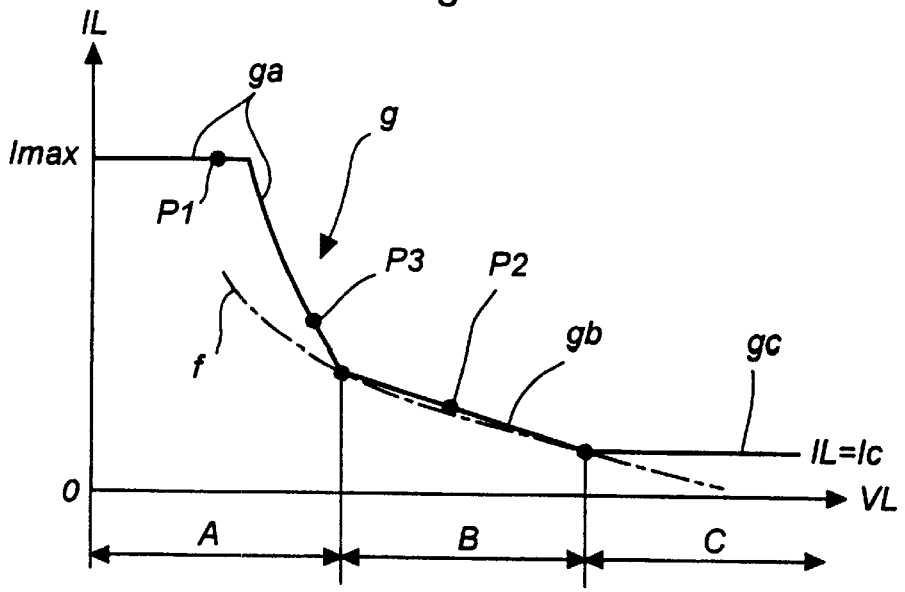
FIG. 2 is a graph for explaining the control characteristic which is associated with the lamp voltage and lamp current of a discharge lamp.

FIG. 2 exemplifies the control characteristics of the power control means 8 with the lamp voltage ("VL") taken on the horizontal scale and the lamp current ("IL") on the vertical scale.

A hyperbola f indicated by the one dot and dash line in the figure shows a constant power curve indicating the rated power of the discharge lamp 7. Of a control line g, a portion gb belonging to an area B shows the control characteristic of the constant power control means 8*b*. That is, "gb" is a line segment or a polygonal line, which matches with a part of the constant power curve f or is acquired by linear approximation to that part.

A portion ga of the control line g which belongs to an area A represents the control characteristic of the lighting acceleration control means 8*a*. This portion ga is designed in such a way that a large lamp current (indicated by "Imax" in the figure) flows when the lamp voltage VL is low, and the lamp current IL gradually gets smaller so that the portion ga becomes integral with the portion gb as the lamp voltage VL increases to a certain level. The transition from the line segment of IL=Imax to the line gb may be achieved by various ways, such as connecting both lines by a straight line or providing a circuit with a predetermined time constant to make the connection by a curve which exponentially decreases from the former line to the latter. In other words, the portion ga may take any shape as long as it is located above the constant power curve f An area C on the right to the area B is where control associated with the lamp current is performed when the lamp voltage VL is high. In this invention, the shape of a control line gc in this area C is not essential.

With the use of this control line g, to activate the discharge lamp 7 from the cold state, a large current is supplied to the discharge lamp 7 at an operational point P1 where IL=Imax, after which the lamp current IL is reduced gradually as the lamp voltage VL increases to an operational point P2 at which constant power control is carried out. When the state of the discharge lamp 7, which has been undergoing constant power control at the operational point P2, shifts to the area A from the area B, power greater than the rated power is supplied to the lamp 7 as indicated at, for example, an operational point P3.

Lighting acceleration control may be hindered by the timer means 9 in the following manners.

(I) To stop the lighting acceleration control until a predetermined time passes from the point at which lighting of the discharge lamp has started.

(II) To stop the lighting acceleration control until a predetermined time passes from the point at which the mode of the discharge lamp has changed to lighting acceleration control from constant power control.

According to the method (I), the lighting acceleration control is performed before a predetermined time elapses from the beginning of the lighting of the discharge lamp, and is not performed thereafter. It is preferable that the time of the timer means 9 be set in consideration of the time for the lamp voltage or lamp current of the discharge lamp to reach the rated range in the case of so-called cold start by which the discharge lamp is activated from the cold state. (The time is taken into account because when the discharge lamp is warm to a certain extent, the time for the lamp voltage or lamp current to reach the rated range is shorter than the one in the cold start case.) Note that the "beginning of the lighting of the discharge lamp" means the point when an instruction to light the discharge lamp has been issued or the point when the discharge lamp is actually activated or lit.

According to this method, when the discharge lamp is in the last stage of life, the lighting acceleration control is finished within the predetermined time even if the control does not shift to the constant power control. This method is therefore effective in the initial lighting stage of the discharge lamp.

The method (II) is designed to cope with a change in the lighting state of the discharge lamp and may be accomplished by the following two ways.

(II-a) To stop lighting acceleration control before a predetermined time elapses from the point at which the lamp voltage and/or the lamp current of the discharge lamp comes off the rated range.

(II-b) To stop lighting acceleration control before a predetermined time elapses from the point at which an increase in the amount of power to be supplied to the discharge lamp is detected.

First, the scheme (II-a) is designed to always monitor the lamp voltage and/or the lamp current of the discharge lamp, or an equivalent signal to the former or the latter or their equivalent signals, determine if such a parameter falls within the rated range, and, when deviation of the parameter(s) from the rated range occurs, terminates lighting acceleration control before the predetermined time passes from the point of the deviation. This scheme is effective both in the initial lighting stage of the discharge lamp and at the time the state of the discharge lamp changes after activation.

The scheme (II-b) is designed to stop lighting acceleration control before the predetermined time elapses from the point when it is detected that an increase in power to be supplied to the discharge lamp becomes equal to or greater than a predetermined value, in the light of a slight change in power to be supplied to the discharge lamp under constant power control. According to this scheme, an increase in power to be supplied to the discharge lamp is acquired by a change in the product of a voltage and a current with lapse of time from the lamp voltage and lamp current of the discharge lamp or their equivalent signals, or is acquired by the sum of the products of a change in the voltage or current with time and the current or voltage. In the case where the state transition of the discharge lamp from constant power control to lighting acceleration control means that an increase in power to be supplied to the discharge lamp is equal to or greater than a predetermined value, however, the point of the occurrence of such an increase in power can easily be determined by detecting the transitional point from the constant power control to the lighting acceleration control.

In either scheme, the inhibition of lighting acceleration control is premised on that the lighting acceleration control is executed when the lighting of the discharge lamp starts or the state of the discharge lamp changes, and such inhibition does not take place when the control is immediately shifted to constant power control as in the case where one wants to turn on the discharge lamp immediately after its deactivation. It should be noted that merely lighting acceleration control is stopped after being executed for a certain time (which is equal to or shorter than the time set by the timer means 9), and power supply to the discharge lamp is not stopped.

Of course, the methods (I) and (II) may be combined. While it is preferable that, with the method (I) alone, lighting acceleration control should not be performed at all to protect the circuit when the state of the discharge lamp under constant power control is changed, the combination of the method (I) and the scheme (II-a) or (II-b) can allow lighting acceleration control to be performed within a predetermined time even when such a status change occurs.

When the aforementioned area C can be considered as a part of the lighting acceleration area (i.e., when the control line gc lies above the constant power curve f), the time restriction to lighting acceleration control by the method (I) and/or the method (II) may be adapted under the condition that the areas A and C are included in the lighting acceleration area.

FIGS. 3 through 9 exemplify this invention as adapted to a lighting circuit for a vehicular discharge lamp.

Figure 3:
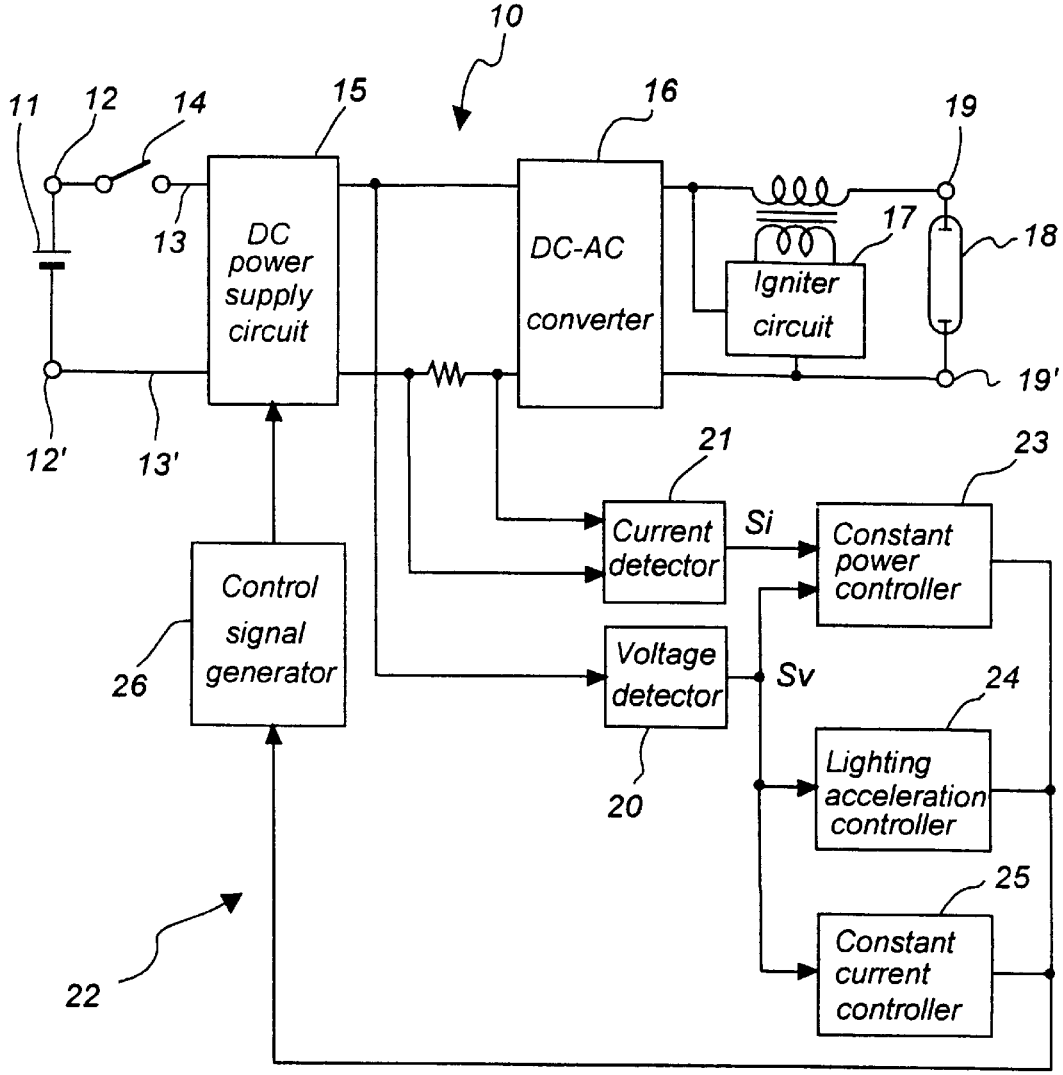
FIG. 3 is a circuit block diagram schematically illustrating one embodiment of this invention.

In a lighting circuit 10 shown in FIG. 3, a battery 11 as a DC power supply is connected between input terminals 12 and 12', and a lighting switch 14 is provided on one (13) of DC power lines 13 and 13'.

A DC power supply circuit 15 boosts and/or decreases the battery voltage. A DC-AC converter 16 converts the output of the DC power supply circuit 15 to an AC voltage.

An igniter circuit 17, located at the subsequent stage of the DC-AC converter 16, generates an activation pulse to be sent to a discharge lamp 18, superimposes this pulse on the output of the DC-AC converter 16, and applies the resultant signal to the discharge lamp 18 which is connected between AC output terminals 19 and 19'.

The DC power supply circuit 15, the DC-AC converter 16 and the igniter circuit 17 are equivalent to the aforementioned lighting control means 5.

Provided at the output stage of the DC power supply circuit 15 are a voltage detector 20 for detecting the output voltage (an equivalent signal to the lamp voltage VL) of the DC power supply circuit 15 and a current detector 21 for detecting the output current (an equivalent signal to the lamp current IL) thereof. Those detection signals are supplied to a control circuit 22.

The control circuit 22 includes a constant power controller 23, a lighting acceleration controller 24, a constant current controller 25 and a control signal generator 26 to generate a control signal corresponding to the detection signal ("Sv") from the voltage detector 20 or a control signal corresponding to the detection signal ("Si") from the current detector 21, send the detection signal to the DC power supply circuit 15 to control the output voltage thereof, execute power control which matches with the activation state of the discharge lamp 18 to thereby shorten the activation time or reactivation time of the discharge lamp 18, and perform control to ensure stable lighting of the discharge lamp 18 in the normal lighting state. The control signal generator 26 generates a feedback signal to be sent to the DC power supply circuit 15 in accordance with the signals from the constant power controller 23, the lighting acceleration controller 24 and the constant current controller 25. The structure of this control signal generator 26 is determined by what control system is to be employed (when PWM (Pulse Width Modulation) type control is used, for example, the control signal generator 26 generates a pulse signal having a duty cycle corresponding to its input signal).

Figure 4:
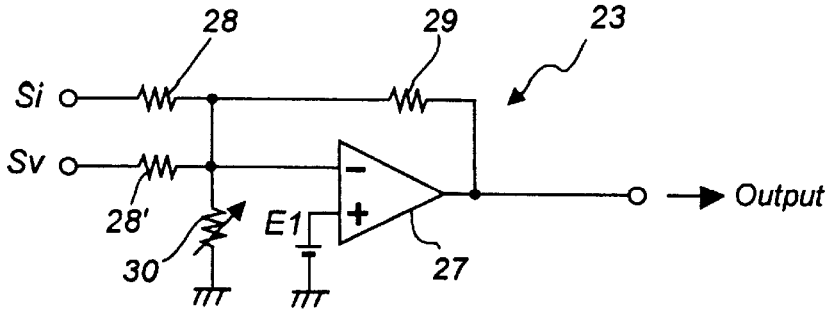
FIG. 4 is a circuit diagram showing one example of a constant power controller.

FIG. 4 shows one example of the constant power controller 23. The aforementioned detection signals Si and Sv are added after passing through respective resistors 28 and 28', and the resultant signal is input to the non-inverting input terminal of an operational amplifier 27 while a predetermined reference voltage E1 (indicated by the symbol of a constant voltage source in the figure) is supplied to the inverting input terminal of the operational amplifier 27. The output signal of the operational amplifier 27 is sent to the control signal generator 26. Accordingly, constant power control for the discharge lamp 18 is executed in accordance with the control line, obtained by linear approximation to the constant power curve f, in such a manner that the sum of the detection signals Sv and Si with a predetermined ratio becomes constant. A resistor 29 in the figure is a feedback resistor inserted between the output terminal and the inverting input terminal of the operational amplifier 27, and a resistor 30 is a variable resistor having one end connected to the inverting input terminal of the operational amplifier 27 and the other end grounded.

Figure 5:
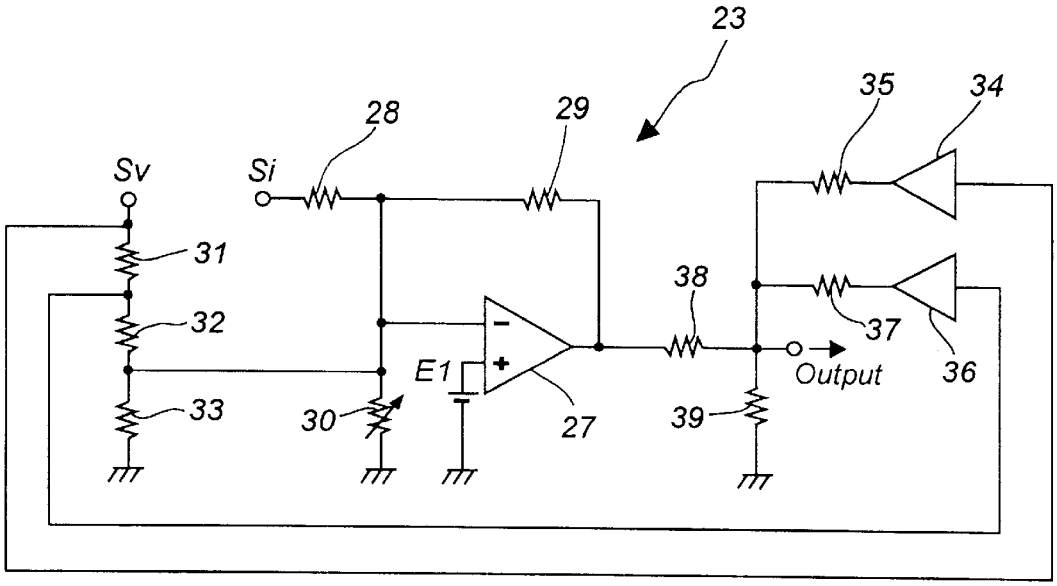
FIG. 5 is a circuit diagram showing another example of the constant power controller.

The constant power controller 23 may be modified as exemplified in FIG. 5. In association with the input of the detection signal Si to the operational amplifier 27, this constant power controller 23 has the same structure as is shown in FIG. 4. The detection signal Sv is voltage-divided by resistors 31, 32 and 33, and the terminal voltage of the resistor 33 is input to the inverting input terminal of the operational amplifier 27. The detection signal Sv is also sent out via a buffer 34 and a resistor 35, and a voltage acquired from a node between the resistors 31 and 32 is sent out via a buffer 36 and a resistor 37. If the outputs of both buffers 34 and 36 and the output from the output terminal of the operational amplifier 27, which is acquired from a node between resistors 38 and 39, are added in multiple stages, it is possible to provide a control line which is the linear approximation of the constant power curve f with a plurality of line segments (three line segments in this case).

Figure 6:
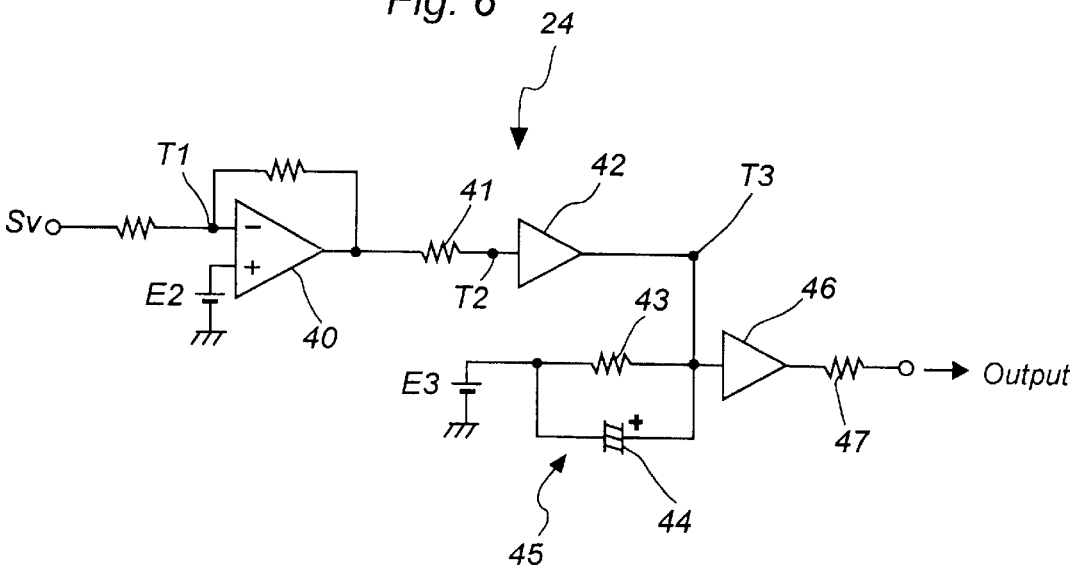
FIG. 6 is a circuit diagram exemplifying a lighting acceleration controller.

FIG. 6 shows an example of the lighting acceleration controller 24 in which the detection signal Sv is input to the inverting input terminal of an operational amplifier 40, and a predetermined reference voltage E2 is supplied to the non-inverting input terminal of the operational amplifier 40. The output terminal of the operational amplifier 40 is connected via a resistor 41 and a buffer 42 to a time constant circuit 45, which comprises a resistor 43, a capacitor 44 and a constant voltage source E3. The output of the operational amplifier 40 is sent to the control signal generator 26 via a buffer 46 and a resistor 47. Specifically, this circuit is designed to perform inversion and amplification of the detection signal Sv and output a high voltage when the level of the detection signal Sv corresponding to the lamp voltage is small, so that the characteristic indicated by the portion ga of the control line g is acquired. The time constant circuit 45 defines the degree of reduction of the lamp current when this lamp current is decreased in accordance with an increase in the level of the detection signal Sv.

Figure 7:
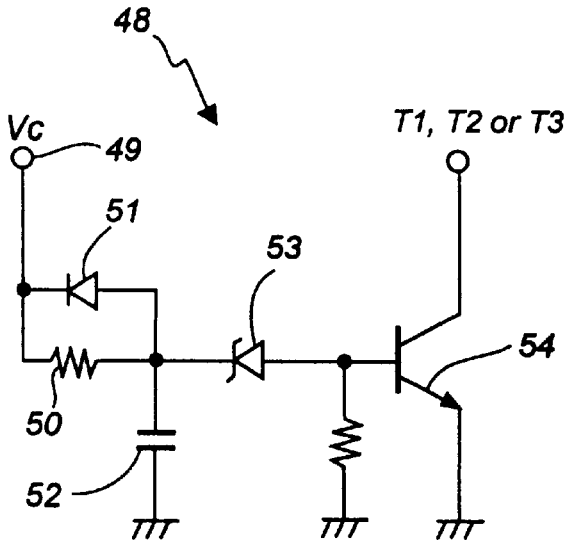
FIG. 7 is a circuit diagram showing one example of timer means.
Figure 8:
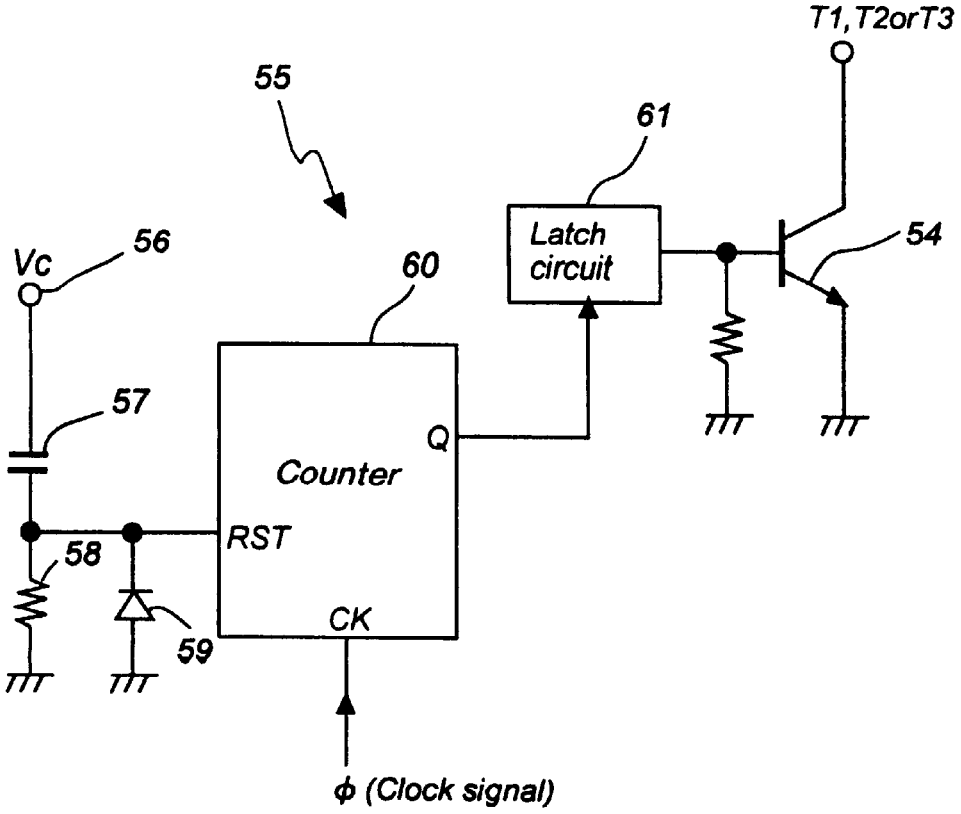
FIG. 8 is a circuit diagram showing another example of the timer means.

The lighting acceleration controller 24 is provided with the timer means 9 which may take a structure as shown in FIG. 7 or 8 to accomplish the method (I).

In a circuit 48 shown in FIG. 7, a predetermined voltage ("Vc") is supplied to a terminal 49 when the lighting of the discharge lamp 18 starts, and is further supplied to a power-on reset circuit, which is comprised of a resistor 50, a diode 51 connected in parallel thereto and a capacitor 52 connected in series to the resistor 50 and diode 51. The terminal voltage of the capacitor 52 is sent via a Zener diode 53 to the base of an emitter-grounded NPN transistor 54. When the collector of the transistor 54 is connected to one of nodes T1 (the inverting input terminal of the operational amplifier 40), T2 (the input terminal of the buffer 42) and T3 (the output terminal of the buffer 42) in the circuit in FIG. 6, the capacitor 52 is charged with the voltage Vc supplied at the beginning of the lighting of the discharge lamp 18. When the terminal voltage of the capacitor 52 rises and reaches a predetermined voltage, the transistor 54 is turned on, forcing the potential at one of the nodes T1, T2 and T3 to a low (L) level. As a result, lighting acceleration control is stopped. In this case, the time is set by the time constant given by the capacitor 52 and resistor 50 and selecting the Zener diode 53.

FIG. 8 shows another circuit example 55 different from that shown in FIG. 7. When the voltage Vc is supplied to a terminal 56 at the beginning of the lighting of the discharge lamp 18, it is then supplied to a power-on reset circuit, which is comprised of a capacitor 57, a resistor 58 and a diode 59, and the output of this power-on reset circuit is input to the reset terminal (RST) of a counter 60. The counter 60 starts counting a clock signal (ø) to be input to its clock input terminal (CK) from the point of reception of the output of the power-on reset circuit. When the count value becomes a predetermined value, a signal is output from a count output terminal (Q) is supplied to the base of the NPN transistor 54 via a latch circuit 61. As the collector of the transistor 54 is connected to one of the nodes T1, T2 and T3, the transistor 54 is turned on when the output of the latch circuit 61 goes high (H). This forces the potential at one of the nodes T1, T2 and T3 to an L level to inhibit lighting acceleration control.

Figure 9:
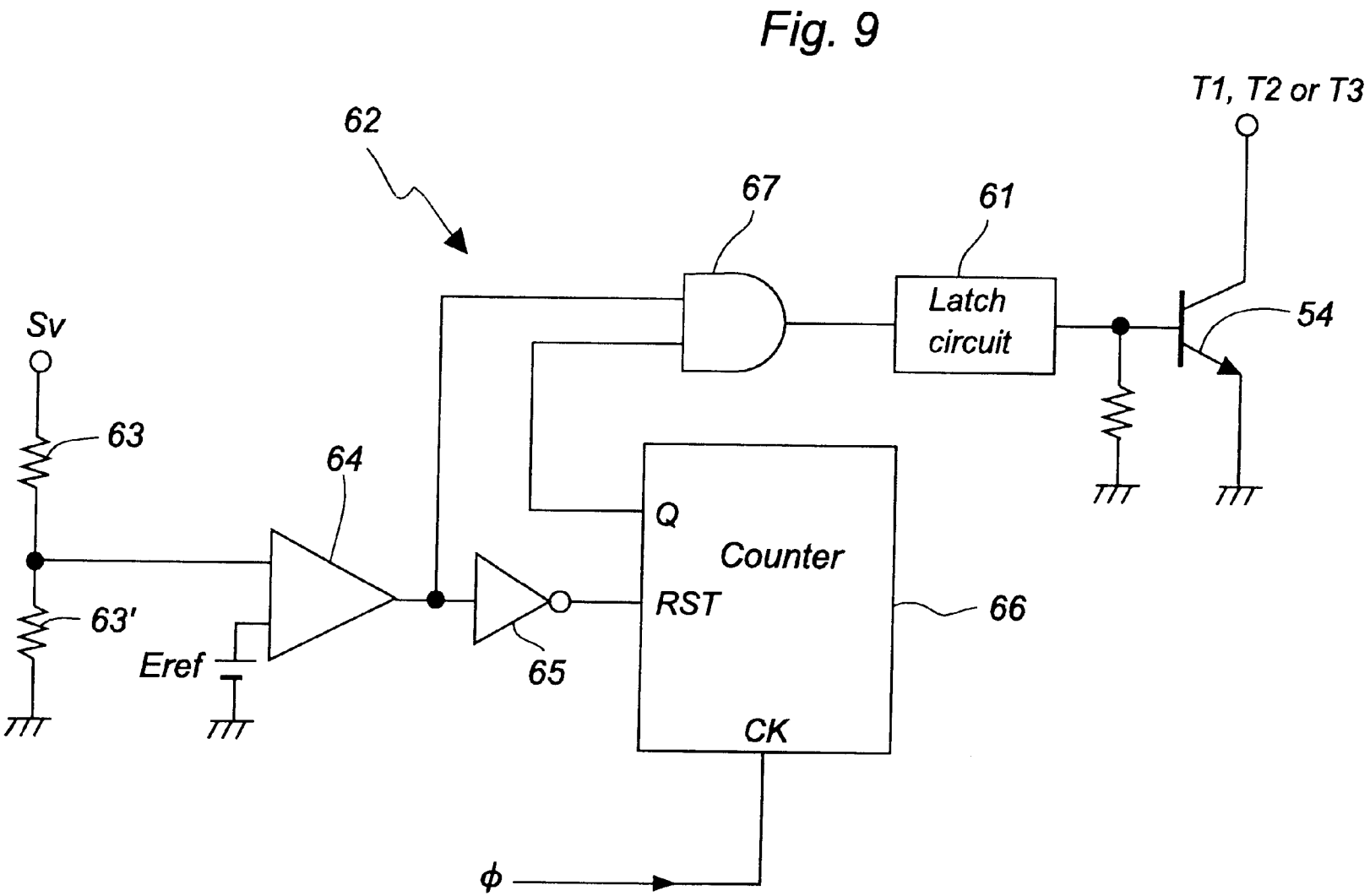
FIG. 9 is a circuit diagram exemplifying timer means which is activated when a voltage detection signal Sv comes off a predetermined range.

FIG. 9 exemplifies the structure of the timer means 9 for the scheme (II-a).

In a circuit 62 in FIG. 9, a signal obtained by voltage-dividing the detection signal Sv by resistors 63 and 63' is input to one of two input terminals of a comparator 64, and a reference voltage Eref corresponding to the rated lamp voltage is supplied to the other input terminal. When the voltage-divided value of the detection signal Sv becomes smaller than the reference voltage Eref, the comparator 64 outputs an H-level signal. The output signal of the comparator 64 is supplied via a NOT gate 65 to the reset terminal (RST) of a counter 66. A signal output from the count output terminal (Q) of the counter 66 when the number of clock signals (ø) counted by the counter 66 reaches a predetermined value, and the output signal of the comparator 64 are input to a AND gate 67 to acquire a signal indicating the logical product of both inputs. This signal is then sent to the base of the transistor 54 via the latch circuit 61. When the lamp voltage falls from the rated voltage, therefore, the output of the comparator 64 changes to an H-level signal from an L-level signal, and counting starts from this point. When a predetermined time passes thereafter, the output of the counter 66 becomes an H-level signal. When the output of the comparator 64 is an H-level signal at this time, the output of the latch circuit 61 becomes an H-level signal, turning on the transistor 54. This forces the potential at one of the nodes T1, T2 and T3 to an L level to stop lighting acceleration control.

Although the voltage-divided value associated with the detection signal Sv is compared with the reference voltage Eref in the circuit in FIG. 9, a voltage-divided value of the output voltage of the DC power supply circuit 15, which has been acquired directly, may be compared with the reference voltage Eref, or a comparator having a hysteresis characteristic may be used to be able to set the rated range for the lamp voltage.

It is obvious that the above-discussed circuit may be used to deal with the detection signal Si of the lamp current. In this case, the reference voltage Eref should be set to a voltage value corresponding to the rated lamp current, and the output signal of the comparator 64 should become an H-level signal when the lamp current exceeds the rated current or comes off the rated current range.

The timer means 9 for the scheme (II-b) may be easily designed by merely modifying what is input to the comparator 64. Specifically, the input terminal of the comparator 64 is connected to any of the nodes T1, T2 and T3 without passing through the voltage-dividing resistors 63 and 63', so that the connected point becomes the point of detection. Under lighting acceleration control in which the potential of the selected node is greater than a predetermined potential, the output of the comparator 64 becomes an H-level signal. Under constant power control, on the other hand, the output of the comparator 64 is an L-level signal. When the control is shifted to lighting acceleration control from constant power control, therefore, this circuit determines that an increase in power to be supplied to the discharge lamp is always equal to or greater than a predetermined value and activates the counter 66 to stop the lighting acceleration control before the predetermined time elapses.

Since the constant current controller 25 defines the shape of the control line gc in the area C in FIG. 2, this embodiment is designed to make the lamp current IL constant irrespective of the lamp voltage VL and the straight line IL=Ic lies above the constant power curve f, the area C plus the area A can be considered as the lighting acceleration area as mentioned earlier. In this case, therefore, it is preferable to stop the operation of the constant current controller 25 as well as to stop the operation of the lighting acceleration controller 24.

The output of the circuit in FIG. 9 may be used to inhibit the operation of the constant current controller 25. Specifically, the circuit may be designed in such a way that when the lamp voltage VL becomes higher than a predetermined voltage (the voltage at the intersection of the boundary between the areas B and C and the control line g), the comparator 64 outputs an H-level signal, and the potential of a predetermined node on the signal lines of the constant current controller 25 is dropped by the output signal of the enabled transistor 54, which is acquired after elapsing of the predetermined time detected by the counter 66, thereby stopping the operation of the constant current controller 25. Although the control section associated with the area C is called the constant current controller due to the function of the control line gc in the area C in this embodiment, the control line gc in the area C may be set to a straight line with a predetermined inclination or a curve. In such cases, the area C plus the area A can be included in the lighting acceleration area as long as the inclined line or the curve lies above the constant power curve f.

According to the first aspect of this invention as apparent from the above, lighting acceleration control can be allowed to be terminated within a predetermined time, so that the lighting acceleration control for a discharge lamp does not continue more than necessary. In the case of the service life of a discharge lamp at its last stage, for example, it is possible to prevent a problem from arising when the lamp voltage and/or the lamp current does not fall within, or comes off, the proper rated range under constant power control, which otherwise causes lighting acceleration control of the discharge lamp to continue for a long period of time.

According to the second aspect of this invention, the lighting circuit needs to be structured in such a way that lighting acceleration control is terminated within a predetermined time after the initiation of the lighting of the discharge lamp. This simplifies the circuit structure. Even if lighting acceleration control is not changed to constant power control when a discharge lamp in the last stage of life is lit, the lighting acceleration control can be stopped within a predetermined time to protect the discharge lamp and the lighting circuit.

According to the third aspect of this invention, the timer means is activated from the point of mode transition of a discharge lamp from constant power control to lighting acceleration control, and the lighting acceleration control is terminated before a predetermined time passes from the transitional point. This lighting circuit can therefore cope with a change in the lighting state of the discharge lamp after the lamp is temporarily lit.

According to the fourth aspect of this invention, it is possible to easily detect the point of transition from constant power control to lighting acceleration control by checking if the lighting state of the discharge lamp comes off the lighting state in the rated range.

According to the fifth aspect of this invention, it is possible to easily detect the point of transition from constant power control to lighting acceleration control by checking if the amount of an increase in power to be supplied to the discharge lamp exceeds a predetermined range.

Therefore, the present examples and embodiments are to be considered as illustrative and not restrictive and the invention is not to be limited to the details given herein, but may be modified within the scope of the appended claims.

What is claimed is:

1. A discharge lamp lighting circuit comprising:

power control means for executing lighting acceleration control to supply power greater than rated power for predetermined normal time to a discharge lamp to thereby expedite lighting of said discharge lamp, and for executing constant power control to supply said discharge lamp with said rated power; and timer means for determining a period of applying said lighting acceleration control, wherein said timer means regulates said period if said power control means provides said lighting acceleration control for an abnormal time longer than said predetermined time, or if said lighting acceleration control applied to said discharge lamp exceeds a rated power of said discharge lamp irrespective of whether or not an abnormality is detected in the lighting circuit, said timer means is activated from a point of mode transition of said discharge lamp from said constant power control to said lighting acceleration control, said lighting acceleration control is terminated until a predetermined time passes from that point, and said power control means executes said constant power control after said lighting acceleration control is terminated.

2. The discharge lamp lighting circuit according to claim 1, wherein said timer means is activated from a point at which a lighting state of said discharge lamp comes off a rated range and said lighting acceleration control is terminated until a predetermined time passes from that point.

3. The discharge lamp lighting circuit according to claim 1, wherein said timer means is activated from a point at which an amount of an increase in power to be supplied to said discharge lamp exceeds a predetermined range and said lighting acceleration control is terminated until a predetermined time passes from that point.

4. A discharge lamp lighting circuit comprising:

power control means for executing lighting acceleration control to supply power greater than rated power for predetermined normal time to a discharge lamp to thereby expedite lighting of said discharge lamp, and for executing constant power control to supply said discharge lamp with said rated power; and timer means for determining a period of applying said lighting acceleration control, wherein said timer means regulates said period if said power control means provides said lighting acceleration control for an abnormal time longer than said predetermined time irrespective of whether or not an abnormality is detected in said lighting circuit and comprises:

a power-on reset circuit comprised of a resistor, a diode connected in parallel to said resistor, and a capacitor connected in series to said resistor and said diode; and an emitter-grounded transistor having a base connected via a Zener diode to said capacitor.

5. A discharge lamp lighting circuit comprising:

power control means for executing lighting acceleration control to supply power greater than rated power for predetermined normal time to a discharge lamp to thereby expedite lighting of said discharge lamp, and for executing constant power control to supply said discharge lamp with said rated power; and timer means for determining a period of applying said lighting acceleration control, wherein said timer means regulates said period if said power control means provides said lighting acceleration control for an abnormal time longer than said predetermined time irrespective of whether or not an abnormality is detected in said lighting circuit and comprises a power-on reset circuit comprised of a capacitor, a resistor and a diode;

a counter, having a reset terminal connected to an output terminal of said power-on reset circuit and a clock input terminal, for counting a clock signal input to said clock input terminal;

a latch circuit connected to an output terminal of said counter;

a transistor connected via said latch circuit to said output terminal of said counter.

6. The discharge lamp lighting circuit according to claims 4 or 5, wherein said timer means is activated from a point at which lighting of said discharge lamp starts and said lighting acceleration control is terminated until a predetermined time passes from that point.

7. The discharge lamp lighting circuit according to claims 4 or 5, wherein said timer means is activated from a point of mode transition of said discharge lamp from said constant power control to said lighting acceleration control, and said lighting acceleration control is terminated until a predetermined time passes from that point.

8. The discharge lamp lighting circuit according to claim 7, wherein said timer means is activated from a point at which a lighting state of said discharge lamp comes off a rated range and said lighting acceleration control is terminated until a predetermined time passes from that point.

9. The discharge lamp lighting circuit according to claim 7, wherein said timer means is activated from a point at which an amount of an increase in power to be supplied to said discharge lamp exceeds a predetermined range and said lighting acceleration control is terminated until a predetermined time passes from that point.

* * * * *